US005157306A

United States Patent [19]

Witting

[11] Patent Number: 5,157,306

[45] Date of Patent: * Oct. 20, 1992

[54] GAS PROBE STARTER FOR AN ELECTRODELESS HIGH INTENSITY DISCHARGE LAMP

[75] Inventor: Harald L. Witting, Burnt Hills, N.Y.

[73] Assignee: General Electric Company, Schenectady, N.Y.

[ * ] Notice: The portion of the term of this patent subsequent to Mar. 10, 2009 has been disclaimed.

[21] Appl. No.: 705,846

[22] Filed: May 28, 1991

[51] Int. Cl.[5] ..... H05B 41/16

[52] U.S. Cl. ..... 315/248; 315/344; 313/234; 313/607; 313/549

[58] Field of Search ..... 313/234, 607, 493, 638, 313/639, 634, 642, 547, 549; 315/248, 39, 344

[56] References Cited

U.S. PATENT DOCUMENTS

| | | | |
|---|---|---|---|
| 4,810,938 | 3/1989 | Johnson et al. | 315/248 |
| 4,812,702 | 3/1989 | Anderson | 313/153 |
| 4,959,584 | 9/1990 | Anderson | 313/493 |
| 4,972,120 | 11/1990 | Witting | 313/638 |
| 5,057,750 | 10/1991 | Farrall et al. | 313/234 |
| 5,095,249 | 3/1992 | Roberts et al. | 313/234 X |

OTHER PUBLICATIONS

Kohl, Walter H.; "Materials and Techniques for Electron Tubes"; Second Printing, 1962.

M. N. Hirsh and H. J. Oskam. "Glow Discharges at DC and Low Frequencies." Gaseous Electronics, vol. I. Academic Press, New York 1978, pp. 19–20.

*Primary Examiner*—Donald J. Yusko

*Assistant Examiner*—N. D. Patel

*Attorney, Agent, or Firm*—Jill M. Breedlove; Marvin Snyder

[57] ABSTRACT

A gas probe starter for an electrodeless HID lamp includes a getter for removing gaseous impurities from the fill contained in the starting chamber of the gas probe starter. In a preferred embodiment, a metal foil having active getter material disposed on the surfaces thereof in the form of a sintered powder is inserted at an optimum location in the starting chamber which depends on the optimum operating temperature of the particular getter material.

10 Claims, 1 Drawing Sheet

GAS PROBE STARTER FOR AN ELECTRODELESS HIGH INTENSITY DISCHARGE LAMP

FIELD OF THE INVENTION

The present invention relates generally to electrodeless high intensity discharge lamps and, more particularly, to an improved gas probe starter therefor.

BACKGROUND OF THE INVENTION

In a high intensity discharge (HID) lamp, a medium to high pressure ionizable gas, such as mercury or sodium vapor, emits visible radiation upon excitation typically caused by passage of current through the gas. One class of HID lamps comprises electrodeless lamps which generate an arc discharge by generating a solenoidal electric field in a high-pressure gaseous lamp fill. In particular, the lamp fill, or discharge plasma, is excited by radio frequency (RF) current in an excitation coil surrounding an arc tube. The arc tube and excitation coil assembly acts essentially as a transformer which couples RF energy to the plasma. That is, the excitation coil acts as a primary coil, and the plasma functions as a single-turn secondary. RF current in the excitation coil produces a time-varying magnetic field, in turn creating an electric field in the plasma which closes completely upon itself, i.e., a solenoidal electric field. Current flows as a result of this electric field, resulting in a toroidal arc discharge in the arc tube.

At room temperature, the solenoidal electric field produced by the excitation coil is typically not high enough to ionize the gaseous fill and thus initiate the arc discharge. One way to overcome this shortcoming is to lower the gas pressure of the fill, for example, by first immersing the arc tube in liquid nitrogen so that the gas temperature is decreased to a very low value and then allowing the gas temperature to increase. As the temperature rises, an optimum gas density is eventually reached for ionization, or breakdown, of the fill to occur so that an arc discharge is initiated. However, the liquid nitrogen method of initiating an arc discharge is not practical for widespread commercial use.

A recently developed starting aid for an electrodeless HID lamp is a gas probe starter, such as that described in commonly assigned, U.S. Pat. No. 5,095,249 of V. D. Roberts et al., issued of Mar. 10, 1992, which is incorporated by reference herein. The gas probe starter of the Roberts et al. patent includes a fixed starting electrode coupled to a starting chamber which is attached to the arc tube and contains a gas. Preferably, the gas in the starting chamber is at a relatively low pressure as compared with that of the arc tube fill. In the chamber, the gas may be switched between conducting and nonconducting states corresponding to lamp-starting and normal running operation, respectively. In particular, during lamp-starting, a starting voltage is applied to the starting electrode, which causes the gas in the chamber to become conductive. As a result, a sufficiently high voltage is capacitively coupled to the inside surface of the arc tube to break down the gaseous fill contained therein, thus initiating an arc discharge. After the lamp has started, the starting voltage is removed from the starting electrode in order to extinguish the relatively low discharge current in the chamber. In this way, leakage currents flowing between the starting electrode and the arc tube are avoided, thereby extending the useful life of the lamp.

In gas probe starters such as those described hereinabove, gaseous impurities are desorbed from the inside walls of the starting chamber. Such gaseous impurities contaminate the inert gas fill in the chamber and thus increase the voltage required to initiate a gas discharge therein. Hence, it is desirable to provide means for removing the gaseous impurities from the starting chamber fill, thereby decreasing the voltage needed to start the lamp.

OBJECTS OF THE INVENTION

Accordingly, an object of the present invention is to provide a new and improved gas probe starter for an electrodeless HID lamp.

Another object of the present invention is to provide a gas probe starter including means for removing gaseous impurities from the starting chamber fill.

Still another object of the present invention is to decrease the voltage needed to initiate an arc discharge in an electrodeless HID lamp by avoiding the presence of gaseous impurities in the starting chamber fill.

SUMMARY OF THE INVENTION

The foregoing and other objects of the present invention are achieved in a new and improved gas probe starter for an electrodeless HID lamp including getter means for removing gaseous impurities from the fill contained in the starting chamber of the gas probe starter. In a preferred embodiment, a getter comprising a metal foil having active getter material disposed on the surfaces thereof is situated at an optimum location in the starting chamber which depends on the optimum operating temperature of the particular getter material Suitable getter materials include the following combinations: zirconium-aluminum; zirconium-iron; and zirconium-nickel. Other suitable getter materials include barium, zirconium, cerium and titanium.

BRIEF DESCRIPTION OF THE DRAWINGS

The features and advantages of the present invention will become apparent from the following detailed description of the invention when read with the accompanying drawing figures in which.

DETAILED DESCRIPTION OF THE INVENTION

Figure 1:
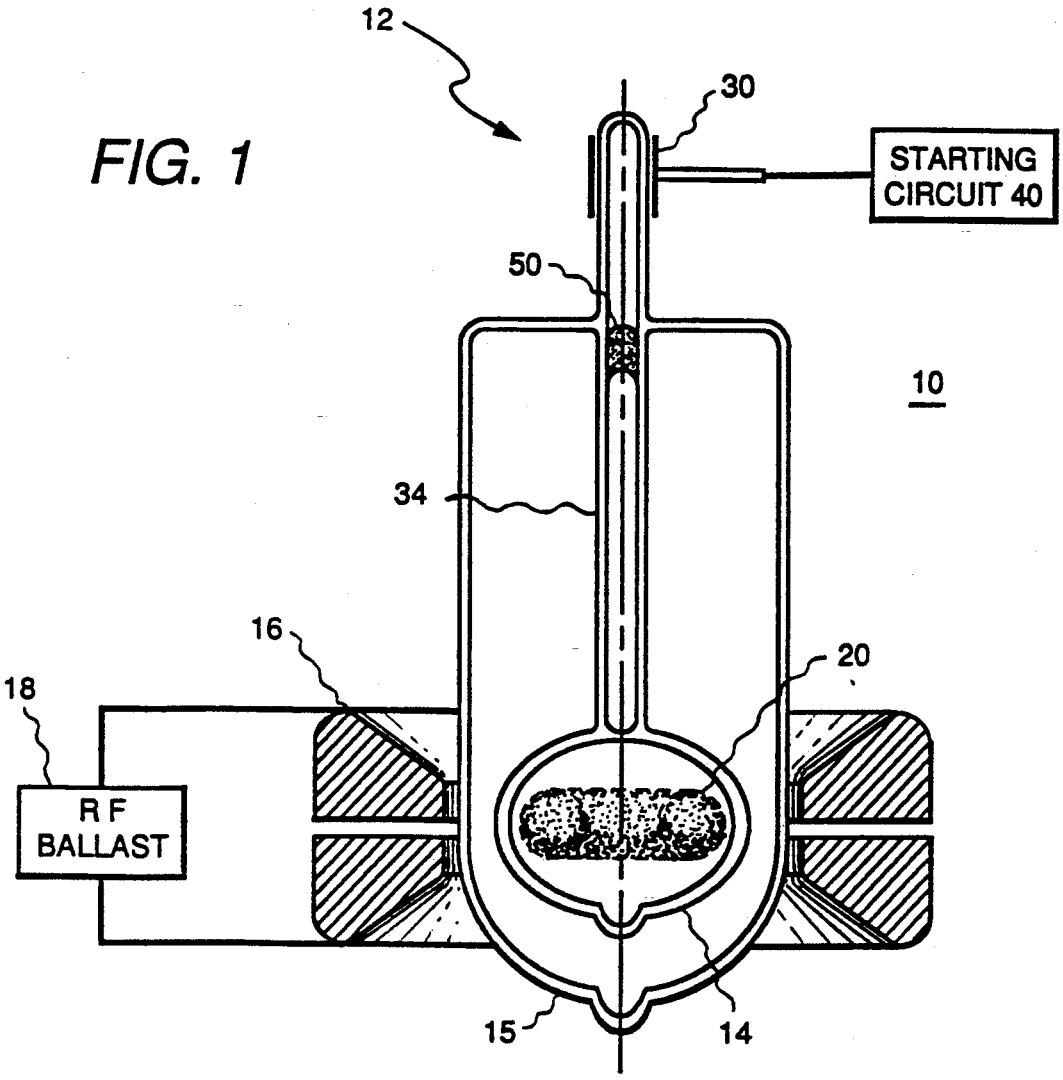
FIG. 1 is a cutaway side view of an electrodeless HID lamp employing an improved gas probe starter in accordance with the present invention.
Figure 2:
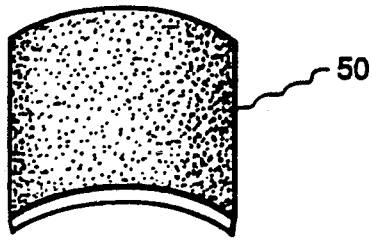
FIG. 2 is an oblique illustration of the starting aid getter of FIG. 1.

FIG. 1 illustrates an electrodeless HID lamp 10 employing a gas probe starter 12 in accordance with a preferred embodiment of the present invention. Lamp 10 includes an arc tube 14 preferably formed of a high temperature glass, such as fused quartz, or an optically transparent or translucent ceramic, such as polycrystalline alumina. Typically, as shown, a light-transmissive envelope 15 surrounds arc tube 14. An excitation coil 16 is disposed about arc tube 14, i.e., outside envelope 15, and is coupled to a radio frequency (RF) ballast 18 for exciting a toroidal arc discharge 20 therein. By way of example, arc tube 14 is shown as having a substantially ellipsoid shape. However., arc tubes of other shapes may be desirable, depending upon the application. For example, arc tube 14 may be spherical or may have the shape of a short cylinder, or "pillbox", having rounded edges, if desired.

Arc tube 14 contains a fill in which an arc discharge having a substantially toroidal shape is excited during lamp operation. A suitable fill is described in U.S. Pat. No. 4,810,938 of P. D. Johnson, J. T. Dakin and J. M. Anderson, issued on Mar. 7, 1989, and assigned to the instant assignee. The fill of the Johnson et al. patent comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. Another suitable fill is described in commonly assigned U.S. Pat. No. 4,972,120 of H. L. Witting, issued Nov. 20, 1990, which patent is incorporated by reference herein. The fill of the Witting application comprises a combination of a lanthanum halide, a sodium halide, a cerium halide and xenon or krypton as a buffer gas. For example, a fill according to the Witting application may comprise a combination of lanthanum iodide, sodium iodide, cerium iodide, and 250 torr partial pressure of xenon.

As illustrated in FIG. 1, RF power is applied to the HID lamp by RF ballast 18 via excitation coil 16 coupled thereto. Excitation coil 16 is illustrated as comprising a two-turn coil having a configuration such as that described in commonly assigned, U.S. Pat. No. 5,039,903 of G. A. Farrall, issued Aug. 13, 1991 and incorporated by reference herein. Such a coil configuration results in very high efficiency and causes only minimal light blockage from the lamp. The overall shape of the excitation coil of the Farrall patent is generally that of a surface formed by rotating a bilaterally symmetrical trapezoid about a coil center line situated in the same plane as the trapezoid, but which line does not intersect the trapezoid. However, other suitable coil configurations may be used with the starting aid of the present invention, such as that described in commonly assigned U.S. Pat. No. 4,812,702 of J. M. Anderson, issued Mar. 14, 1989, which patent is incorporated by reference herein. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing toroidal arc discharge 20 therein. Suitable operating frequencies for RF ballast 18 are in the range from 0.1 to 300 megahertz (MHz), exemplary operating frequencies being 6.78 MHz and 13.56 MHz.

As shown in FIG. 1, gas probe starter 12 comprises a starting electrode 30 coupled to a starting chamber 34 which is attached to the outer wall of arc tube 14 and contains a gas. Specifically, starting electrode 30 is shown being situated about chamber 34 and in contact therewith. However, other suitable configurations (not shown) include situating the electrode either within the interior of the chamber or outside the chamber, but in close proximity thereto.

The gas in starting chamber 34 may comprise, for example, a rare gas, such as neon, krypton, xenon, argon, helium, or mixtures thereof, at a pressure in the range from approximately 0.5 to 500 torr, a preferred range being from approximately 5 to 40 torr. Preferably, the gas in chamber 34 is at a relatively low pressure as compared with that of the arc tube fill in order to promote even easier starting. For example, a suitable arc tube fill pressure may be approximately 200 torr while that of the gas in chamber 34 may be approximately 20 torr.

In order to start lamp 10, a starting voltage is applied to electrode 30 via a starting circuit 40, causing the gas in chamber 34 to break down, or ionize, and thus become conductive. The discharge in the starting chamber may be characterized as either a glow discharge or an arc discharge, depending upon the pressure of the gas in chamber 34. At the low-end of the aforementioned gas pressure range, the discharge is more likely to be characterized as a glow, while at the high-end of the gas pressure range, the discharge is more likely to be characterized as an arc. However, there is no generally accepted definition which distinguishes between glow and arc discharges. For example, as described by John H. Ingold in "Glow Discharges at DC and Low Frequencies" from Gaseous Electronics, vol. I, edited by M. N. Hirsh and H. J. Oskam, Academic Press, N.Y., 1978, pp. 19–20, one definition is based on electrode-related phenomena, and another is based on electron and particle temperatures.

As a result of the discharge current in starting chamber 34, a sufficiently high starting voltage is capacitively coupled to the inside surface of arc tube 14 which causes the high-pressure gaseous fill contained therein to break down, thereby initiating arc discharge 20. Once the arc discharge is initiated, the starting voltage is either removed from starting electrode 30, or the magnitude thereof is decreased to a sufficiently low value, so that the discharge current in chamber 34 is extinguished. That is, the gas contained in chamber 34 becomes essentially nonconductive, thus providing a high-impedance path between starting electrode 30 and arc tube 14. Hence, the arc tube is protected during lamp operation from capacitively coupled currents which would otherwise flow between the starting electrode and the arc tube.

Disadvantageously, however, during lamp operation, gaseous impurities are desorbed from the wall of starting chamber 34 which contaminate the gaseous fill in the starting chamber. Visible evidence of this contamination is found in changes in the color and shape of the discharge within the starting chamber. Such gaseous impurities may include, as examples, water vapor, hydrogen, carbon monoxide, carbon dioxide and oxygen. As the presence of such gaseous impurities increases, the voltage required to initiate a gas discharge in the starting chamber also increases. As a result, the ease and reliability of lamp-starting decrease as the lamp is operated over time. Hence, in accordance with the present invention, getter means is employed in starting chamber 34 for removing the gaseous impurities from the starting chamber fill. In this way, a build up of gaseous impurities in the starting chamber fill is avoided, and starting continues to be easy and reliable over the life of the lamp.

A preferred embodiment of a starting aid getter means is shown in FIG. 1 as being situated in starting chamber 34 and comprising a metal foil 50 having an active getter material disposed on its surfaces, e.g., in the form of a sintered powder. By way of example, the metal foil is illustrated as having a substantially U-shape with its largest transverse dimension being greater than the inner diameter of the starting chamber. Advantageously, a getter configured as illustrated in FIG. 1 is held in place by friction, thus requiring no additional mechanical supporting apparatus.

Suitable metals include nickel, iron, steel and stainless steel. Suitable getter materials include the following combinations: zirconium-aluminum; zirconium-iron; and zirconium-nickel. Other suitable getter materials include barium, zirconium, cerium and titanium. The getter is preferably situated in the starting chamber at a location at the optimum operating temperature for the particular getter material. Advantageously, the optimum temperature for a wide range of getter materials can be accommodated because the temperature of the gas probe starter may range, for example, from about 700° C. closest to the arc tube to about 300° C. farthest from the arc tube.

EXAMPLE

Two lamps A and B were built using getters comprised of zirconium-titanium powders sintered onto metal foils, such as the type St101 made by Saes Getters S.p.A. The getter foils were cut into squares with approximately 9mm long sides, folded into U-shapes and inserted into the starting aid chamber at the approximate location shown in FIG. 1. The getters reached a temperature of approximately 400° C. during lamp operation.

In assembling the improved gas probe starter, the starting chamber is evacuated (e.g., by connection to a vacuum pump) after the getter has been inserted into the starting probe. The getter is then activated by, as examples, oven baking or induction heating. Finally, the starting chamber is filled with the starting gas and then sealed.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A gas probe starter for an electrodeless high intensity discharge lamp of the type having an excitation coil situated about an arc tube for exciting an arc discharge in an ionizable fill contained in said arc tube, comprising:

a starting chamber having a wall enclosing an interior containing a gaseous fill, said starting chamber being attached to the outer wall of said arc tube;

a starting electrode disposed proximate to the portion of said starting chamber opposite to the portion that is attached to said arc tube for coupling a starting voltage to the interior of said starting chamber;

getter means disposed in said starting chamber for removing gaseous impurities from the fill contained therein;

means for coupling said starting voltage to said starting electrode for initiating a discharge in said starting chamber that in turn initiates an arc discharge in said arc tube and for reducing said starting voltage after the arc discharge is initiated to such a level that no substantial leakage currents flow between said starting chamber and said arc tube.

2. The starter of claim 1 wherein said getter means comprises a metal foil having a getter material disposed thereon.

3. The starter of claim 2 wherein said getter material comprises a combination of zirconium and aluminum.

4. The starter of claim 2 wherein said getter material comprises a combination of zirconium and iron.

5. The starter of claim 2 wherein said getter material comprises a combination of zirconium and nickel.

6. The starter of claim 2 wherein said getter material is selected from the group consisting of barium, zirconium, cerium, titanium and mixtures thereof.

7. The starter of claim 1 wherein the gas in said starting chamber comprises a rare gas selected from the group consisting of neon, argon, krypton, xenon, helium, and mixtures thereof.

8. The starter of claim 1 wherein the gas in said starting chamber is contained at a pressure in the range from approximately 0.5 to 500 torr.

9. The starter of claim 1 wherein the gas in said starting chamber is contained at a pressure in the range from approximately 5 to 40 torr.

10. The starter of claim 1 wherein the gas in said starting chamber is at a relatively low pressure as compared with the pressure of said fill.

* * * * *